US006901610B1

(12) United States Patent
Jensen et al.

(10) Patent No.: US 6,901,610 B1
(45) Date of Patent: Jun. 7, 2005

(54) HIGH PERFORMANCE VALVE ASSEMBLY FOR TOILETS

(75) Inventors: Robert Jensen, East Brunswick, NJ (US); Joseph Unkyung Han, Irvine, CA (US)

(73) Assignee: American Standard International, Inc., New York, NY (US)

( * ) Notice: Subject to any disclaimer, the term of this patent is extended or adjusted under 35 U.S.C. 154(b) by 24 days.

(21) Appl. No.: 10/813,497

(22) Filed: Mar. 29, 2004

(51) Int. Cl.[7] ..... E03D 1/34
(52) U.S. Cl. ..... 4/378; 4/324; 4/390; 4/391
(58) Field of Search ..... 4/324, 325, 378, 4/390, 391, 398–400, 405

(56) References Cited

U.S. PATENT DOCUMENTS

| | | | | |
|---|---|---|---|---|
| 978,914 | A * | 12/1910 | Madden | 4/391 |
| 4,604,763 | A * | 8/1986 | Sprang | 4/391 |
| 5,329,647 | A * | 7/1994 | Condon | 4/378 |
| 6,237,164 | B1 * | 5/2001 | LaFontaine et al. | 4/398 |
| 6,715,162 | B2 * | 4/2004 | Han et al. | 4/391 |
| 6,728,975 | B2 * | 5/2004 | Han | 4/378 |

* cited by examiner

*Primary Examiner*—Tuan Nguyen

(57) ABSTRACT

A flush valve assembly includes a valve body with a first cylindrical tube member and a flush cover member that is coaxially and slidably mounted with respect to the valve body so as to create a valve opening therebetween when the flush cover member is removed from the valve body. A guiding means is provided that includes a second cylindrical tube member secured to the flush cover member and slidably fitted over the first cylindrical tube member. The guiding means further includes at least one alignment tab on the flush cover member that engages a corresponding tab recess defined in the valve body. A secondary float assembly pivotably affixed to the valve body has a flotation cup with a resilient member integral therewith. A pawl member includes retention members in combination with each of a primary finger and a secondary finger that engage an integral tab portion along an outside peripheral surface of the flush cover member during reciprocating movement of the flush cover member. A trip release mechanism that is coaxially mounted with respect to the valve body and flush cover member releases the effect of a flush lever on the flush cover member when the flush cover member reaches a position that permits fluid flow through the valve opening. A baffle cup is provided that has an outer periphery defining a float cavity therewithin and at least one aperture provided therethrough to establish communication among the flush lever, baffle cup and trip release means.

30 Claims, 13 Drawing Sheets

HIGH PERFORMANCE VALVE ASSEMBLY FOR TOILETS

FIELD OF THE INVENTION

The present invention is directed to a flush valve assembly for use in a water tank of a toilet. More particularly, the present invention is directed to a flush valve assembly having a coaxial design that provides enhanced energy throughput and thereby optimizes the amount of available energy to effect waste removal from the toilet bowl. The valve assembly of the present invention consistently maximizes energy throughput by employing a large orifice diameter in combination with a trip release mechanism and a secondary float assembly pivotably affixed to a valve body. The flush valve of the present invention also includes shock-absorbing structure for quiet closure of the valve opening and a baffle cup that reduces splashing within the tank.

BACKGROUND OF THE INVENTION

Toilets for removing waste products are well known. Typically, toilets incorporate three systems that work together to perform the flushing action: the bowl siphon, the flush mechanism and the refill mechanism. Working in concert, these three systems allow the flushing function of the toilet. Usually, the tank, positioned over the back of the bowl, contains water that is used to initiate the siphoning from the bowl to the sewage line, after which fresh water refills the bowl. When a user desires to flush the toilet, the user depresses the flush lever on the outside of the tank, which is connected on the inside of the tank to a movable chain or lever. Upon depression, the flush lever moves a chain or lever on the inside of the tank, thereby lifting and opening the flush valve and to cause water to flow from the tank and into the bowl initiate the toilet flush.

In many toilet designs, water flows directly into the bowl and disperses into the rim of the toilet bowl. The water releases into the bowl rather quickly, with flow form the tank into the bowl typically lasting approximately 2 to 4 seconds. The water flows from the rim, down a channel within the sides of the bowl and into the large hole at the bottom of the toilet (commonly known as a siphon jet). The siphon jet releases most of the water into an adjoining siphon tube, thereby initiating the siphon action. The siphoning action draws all of the water and waste out of the bowl and into the siphon tube. The waste and water continues through the other end of the siphon tube through an area known as the trapway and is then released into the wastewater line connected at the base of the toilet. Once the tank is emptied of its contents during the flush, the flush valve closes, and a floating mechanism which has now dropped in the tank to some residual amount initiates the opening of the filler valve. The filler valve provides fresh water to both the tank and the bowl through separate flows. Eventually the tank fills with water to a high enough level to cause the float to rise, thus shutting off the filler valve. At this point, the flushing cycle is complete.

The excessive consumption of potable water, however, remains a dilemma for water agencies, commercial building owners, homeowners, residents and sanitaryware manufacturers. An increasing global population has negatively affected the amount and quality of suitable water. In response to this global dilemma, many local and federal authorities have enacted regulations that reduce the water demand required by toilet flushing operations. In the United States, for instance, government agencies that regulate water usage have gradually reduced the threshold for fresh water use in toilets, from 7 gallons/flush (prior to the 1950s) to 5.5 gallons/flush (by the end of the 1960s) to 3.5 gallons/flush (in the 1980s). The National Energy Policy Act of 1995 now mandates that toilets sold in the United States can only use 1.6 gallons/flush (6 liters/flush). Current agency requirements further mandate that the activation means (usually the flush lever or button) for the flush valve assembly sustain a minimum "hold down" time of 1 second without exceeding 1.6 gallons/flush (6 liters/flush). It has been found, however, that the hydraulic performance characteristics of the flush valve are significantly enhanced if water evacuates the tank in a dumping time of less than 1 second, preferably 0.5 to 0.6 seconds.

Sanitaryware and flush valve manufacturers have attempted various techniques to comply with reduced water requirements and minimum "hold down" times. Such compliance has proven difficult to combine with enhanced flushing and sanitary performance. In the crowded art of producing a more reliable, more efficient and more powerful 1.6 gallon (6 liter) gravity toilet, one method to more effectively remove waste from the toilet bowl is to increase the hydraulic energy available during the flushing operation. Unfortunately, conventional flush valve configurations employ a coaxial flush valve assembly wherein the effective flow diameter through the flush valve opening is less than the orifice diameter of the flush valve inlet under dynamic conditions. Such configurations therefore do not utilize the maximum available hydraulic energy.

The inventor has overcome such detriments in toilet technology in co-pending application U.S. Ser. No. 10/232,878, filed Aug. 30, 2002 and entitled HIGH PERFORMANCE FLUSH VALVE ASSEMBLY (the entire disclosure of which is hereby incorporated by reference). This application discloses a flush valve assembly for a water tank of a toilet that includes a valve body secured thereto. The valve body has a base sleeve portion including a radiused inlet to increase the discharge coefficient of the valve opening. A flush cover member is coaxially and slidably mounted with respect to the valve body so that the valve opening is created therebetween when the flush cover member is removed form the valve body via reciprocating motion. The flush cover member is slidably movable between a first position, wherein the flush cover member is seated on the base sleeve portion of the valve body and thereby obstructs water flow through the valve opening, and a second position, wherein the second valve member is removed from the base sleeve portion of the valve body to permit water flow through the valve opening. A sealing member is provided to ensure a proper seal when the flush cover member is in the first position, and a guiding means is provided that properly aligns and guides the flush valve cover relative to the valve body. The flush valve assembly also includes a trip release mechanism that releases the effects of the flush lever on the flush cover member when the flush cover member reaches its second position, thereby returning the flush cover member to its first rest position prior to the flush lever returning to its own corresponding rest position. In this configuration, the disclosed flush valve assembly ensures compliance with the mandated water requirements and simultaneously provides enhanced cleanliness and waste removal capabilities. The flush valve assembly achieves these functions and also releases the effect of the flush lever so that the valve opening can close before the expiration of the mandated minimum "hold down" time (1 second without exceeding the total water per flush mandate of 1.6 gallons (6 liters)).

It is desirable to provide the aforementioned benefits in a flush valve assembly having additional flushing features. In particular, it is desirable to provide a flush valve assembly with enhanced noise dampening qualities and minimal splash back of water in the toilet tank. Such features should be incorporated in the flush valve assembly without compromising the water conservation benefits and hold down time of the prior disclosed flush valve assembly.

SUMMARY OF THE INVENTION

It is an advantage of the present invention to provide a flush valve assembly that overcomes the deficiencies of conventional flush valve assemblies.

It is also an advantage of the present invention to provide a flush valve assembly having optimal energy throughout of the flush water in comparison to existing flush valve assemblies to thereby provide more available energy for waste removal from the toilet bowl.

It is a further advantage of the present invention to provide a flush valve assembly that satisfies governmental agency requirements for a minimum "hold down" duration.

It is yet a further advantage of the present invention to provide a flush valve assembly that includes a "trip-release" mechanism to release the effect of the flush activation member (i.e., flush lever) upon closure of the valve opening so that a predetermined quantity of flush water is quickly delivered into the toilet bowl without exceeding mandated agency requirements.

It is still a further advantage of the present invention to provide a flush valve assembly having all of the aforementioned benefits in combination with noise reduction capabilities.

It is still another advantage of the present invention to provide a flush valve assembly having all of the aforementioned benefits in combination with reduced splashback of fluid in the toilet tank.

In accordance with these and other advantages, the present invention provides a flush valve assembly for a water tank of a toilet. The flush valve assembly of the present invention includes a valve body having a base portion that is secured to the water tank and a first cylindrical tube member that extends longitudinally upward from the base portion along a longitudinal axis of the valve body. The first cylindrical tube member is concentrically defined relative to an annular support that supports an annular insert thereon and an annular base adjacent the base portion. A flush cover member having a predetermined length is coaxially and slidably mounted with respect to the valve body so as to create a valve opening therebetween when the flush cover member is removed from the valve body. The flush cover member is slidably movable between a first rest position, wherein the flush cover member is seated on an inner peripheral flange member of the base portion of the valve body to obstruct fluid flow through the valve opening, and a second position, wherein the flush cover member is removed from the inner peripheral flange member to allow water to pass through the valve opening. A guiding means is provided for properly guiding and aligning the flush cover member with respect to the valve body when the flush cover member is moved between the first and second positions. This guiding means includes a second cylindrical tube member secured to the flush cover member and slidably fitted over the first cylindrical tube member so that the flush cover member is properly guided and accurately aligned with the valve body when the flush cover member is moved between its first and second positions. The guiding means further includes at least one alignment tab on the flush cover member that remains in sliding engagement with at least one corresponding tab recesses defined in the valve body so as to enable longitudinal and central alignment of the flush cover member relative to the valve body.

The flush valve assembly of the present invention may also include a secondary float assembly pivotably affixed to the valve body. The secondary float assembly includes a flotation cup having a wall defining the periphery thereof and a flotation cavity therewithin, and a resilient member integral with the flotation cup. The resilient member engages one of a plurality of ratcheted teeth provided on a cantilever portion of a pawl member in communication with the flotation cup. A recess is defined along a length of the wall adjacent the pawl member so as to receive a flange portion thereof and effect securement of the flotation cup and the pawl member to one another. The pawl member further includes retention members in combination with each of a primary finger and a secondary finger that engage the flush cover member during reciprocating movement thereof. More specifically, an integral tab portion along an outside peripheral surface of the flush cover member engages at least one of the primary finger and secondary finger when the flush cover member moves between its first rest position and its second position. The secondary float assembly communicates with the valve body and flush cover member via engagement of the secondary float assembly with a portion of the valve body.

The flush valve assembly of the present invention cooperates with a flush lever displaceable by a user between a first rest position and a second position to operatively move the flush cover member between its first rest position and its second position, respectively. The flush valve assembly may further include trip release means for releasing the effect of the flush lever on the flush cover member when the flush cover member reaches its second position. The trip release means is a trip release mechanism coaxially mounted with respect to the valve body and flush cover member. The trip release mechanism includes a cam rod; a pull rod operatively connected to the flush lever and slidably mounted with respect to the cam rod so that the pull rod and cam rod are movable in response to movement of the flush lever; and a trip dog assembly including means for engaging the flush cover member when the pull rod and cam rod are moved between a first rest position and a second predetermined position, and means for disengaging the flush cover member when the pull rod moves beyond its second predetermined position. The cam rod is mounted within the first cylindrical tube of the valve body, which includes an inwardly extending annular flange member to restrict movement of the cam rod past its second predetermined position. A baffle cup is provided that has an outer periphery defining a float cavity therewithin and having at least one aperture provided therethrough to establish communication among the flush lever, baffle cup and trip release means.

Various other advantages and features of the present invention will become readily apparent from the ensuing detailed description and the novel feature will be particularly pointed out in the appended claims.

DETAILED DESCRIPTION OF THE PREFERRED EMBODIMENTS

Figure 1:
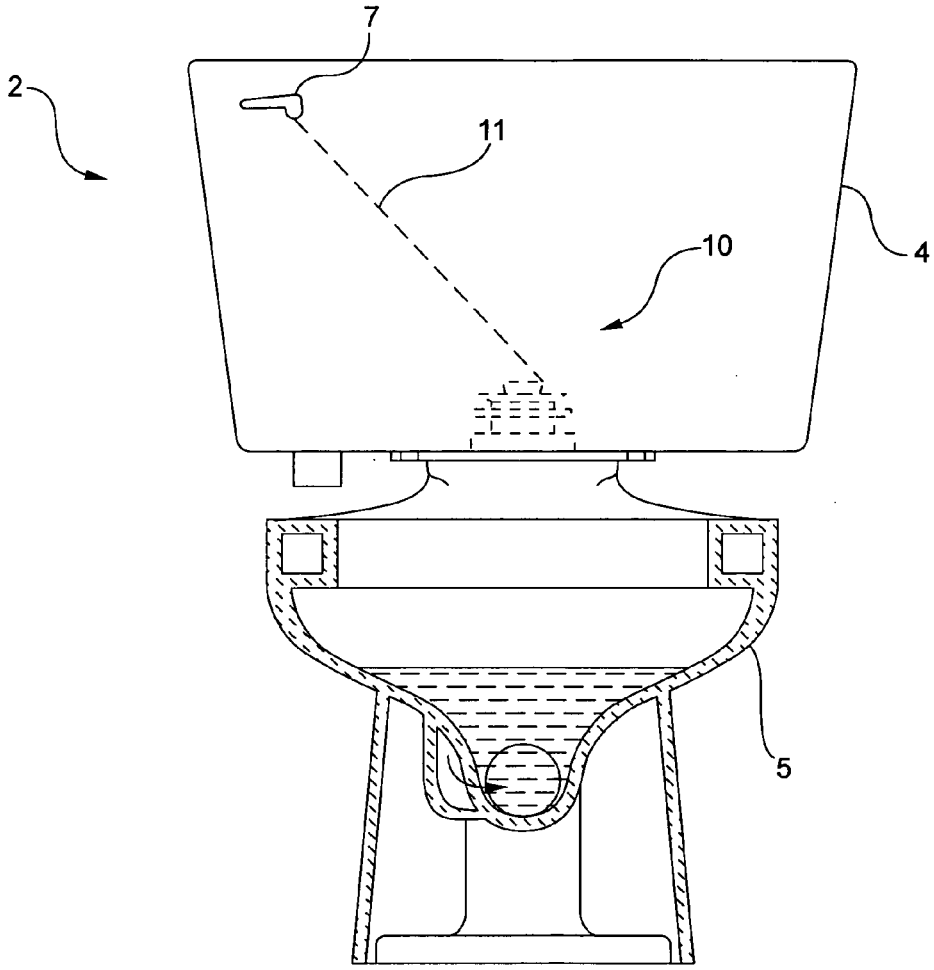
FIG. 1 shows a schematic of a toilet assembly having a tank within which a flush valve assembly of the present invention is utilized.

A flush valve assembly 10 in accordance with the teachings of the present invention is illustrated in FIG. 1 incorporated in a toilet assembly 2. As will be explained in more detail below, flush valve assembly 10, which is provided in a water tank 4, has a greater energy throughput of flush water in comparison to existing flush valves assemblies to thereby utilize maximum available energy to remove waste from toilet bowl 5. In addition, the present invention enables a toilet to meet regulatory mandates that require a minimum hold down time of 1 second and a maximum water usage of 1.6 gallons (6 liters) per flush. Flush valve assembly 10 allows water tank 4 to hold a predetermined volume of water and also supply a conduit to deliver reseal water to the toilet trapway via the passages within the toilet (this delivery is well known within the art). As illustrated in FIGS. 2 to 11, flush valve assembly 10 of the present invention includes valve body 12, flush cover member 14 of a predetermined length and a trip-release mechanism 16 (as described further hereinbelow).

Valve body 12 includes base portion 18 that is secured to water tank 4 by one or more fasteners inserted through corresponding apertures 18*a* provided along an outer peripheral extent 18*b* of base portion 18. Valve body 12 also includes a first cylindrical tube member 20 that extends longitudinally upward from base portion 18 along a longitudinal axis of valve member 12. Cylindrical tube member 20 is concentrically defined relative to annular support 12*a* of valve member 12 that supports annular insert 22 thereon (described further herenbelow) and annular base 12*b* adjacent base portion 18. A plurality of support members 24 extending between annular support 12*a* and annular base 12*b* are distributed generally circumferentially relative thereto. A sealing member 26 is provided adjacent valve body 12 so as to abut against an annular flange surface 18*c* of base portion 18 and thereby seals flush valve assembly 10 to the water tank.

Base portion 18 of valve body 12 includes a radiused inlet 38 having has an approximate diameter of 4.5" with a radius b of 1" (see FIG. 4) incorporated onto the leading edge 38*a* of the inlet. As a result, radiused inlet 38*a* of base portion 18 creates a discharge coefficient of the valve opening of approximately 0.95. The discharge coefficient is the ratio between the actual flow area of the opening area and the static opening area. In practice, the higher the discharge coefficient of the opening, the greater the hydraulic energy of the water passing through the opening. Without providing a radiused inlet at the valve opening with a lead-in angle as in the present invention, the discharge coefficient of the typical prior valve opening is approximately 0.6. Accordingly, the throughput energy of the flush water passing through valve opening 30 of flush valve assembly 10 substantially exceeds the throughput energy of the flush water passing through existing valve assemblies of the prior art, thereby generating more available energy for waste removal.

Flush cover member 14 is an enclosure component that is coaxially and slidably mounted with respect to valve body 12 so as to create a valve opening 30 therebetween when the flush cover member is removed from the valve body. Flush cover member 14 is slidably movable between a first rest position, wherein the flush cover member is seated on an inner peripheral flange member 32 of base portion 18 of valve body 12 so that water cannot pass through the valve opening (see FIGS. 2, 4, 7, 8 and 11), and a second position, wherein the flush cover member is removed from the inner peripheral flange member to allow water to pass through the valve opening (see FIGS. 5, 6, 9 and 10). The second position comprises the end of the flush cycle, and thereby assumption of the second position determines the duration of the flush.

When in the closed position, valve opening 30 is obstructed, thereby preventing the passage of flush water therethrough until actuation of flush valve assembly 10 by a flush activation member such as displaceable flush lever 7 (shown in FIG. 1 in communication with flush valve assembly 10 via activation chain 11). In the open position, valve opening 30 allows flush water to flow therethrough and proceed into passages within the toilet to which the water tank is attached (as is known in the art). In order to accommodate unrestricted overflow in water tank 4, flush cover member 14 includes a funneled inlet 39 at flush water inlet orifice 40. Funneled inlet 39 has a predetermined lead-in angle β relative to the horizontal axis of flush cover member 14 (see FIG. 4).

As in conventional flush valve assemblies, flush cover member 14 initially moves from its first rest position, wherein valve opening 30 is closed, to a second position, wherein valve opening 30 is opened by means of flush lever 7. Flush lever 7 is displaceable by a user between a first rest position and a second open position corresponding to movement of flush cover member 14 between its first and second positions, respectively. Flush cover member 14 is desirably a non-buoyant member.

In order to reduce hydraulic losses and further improve the flow characteristics of flush valve assembly 10, valve body 12 includes means to minimize flow resistance. This flow resistance minimization means desirably includes a plurality of tapered web members 58 radially disposed between first cylindrical tube member 20 and an inner peripheral portion 60 of base portion 18 of valve body 12. This configuration minimizes the turbulence of the flush water passing through valve opening 30.

Figure 2:
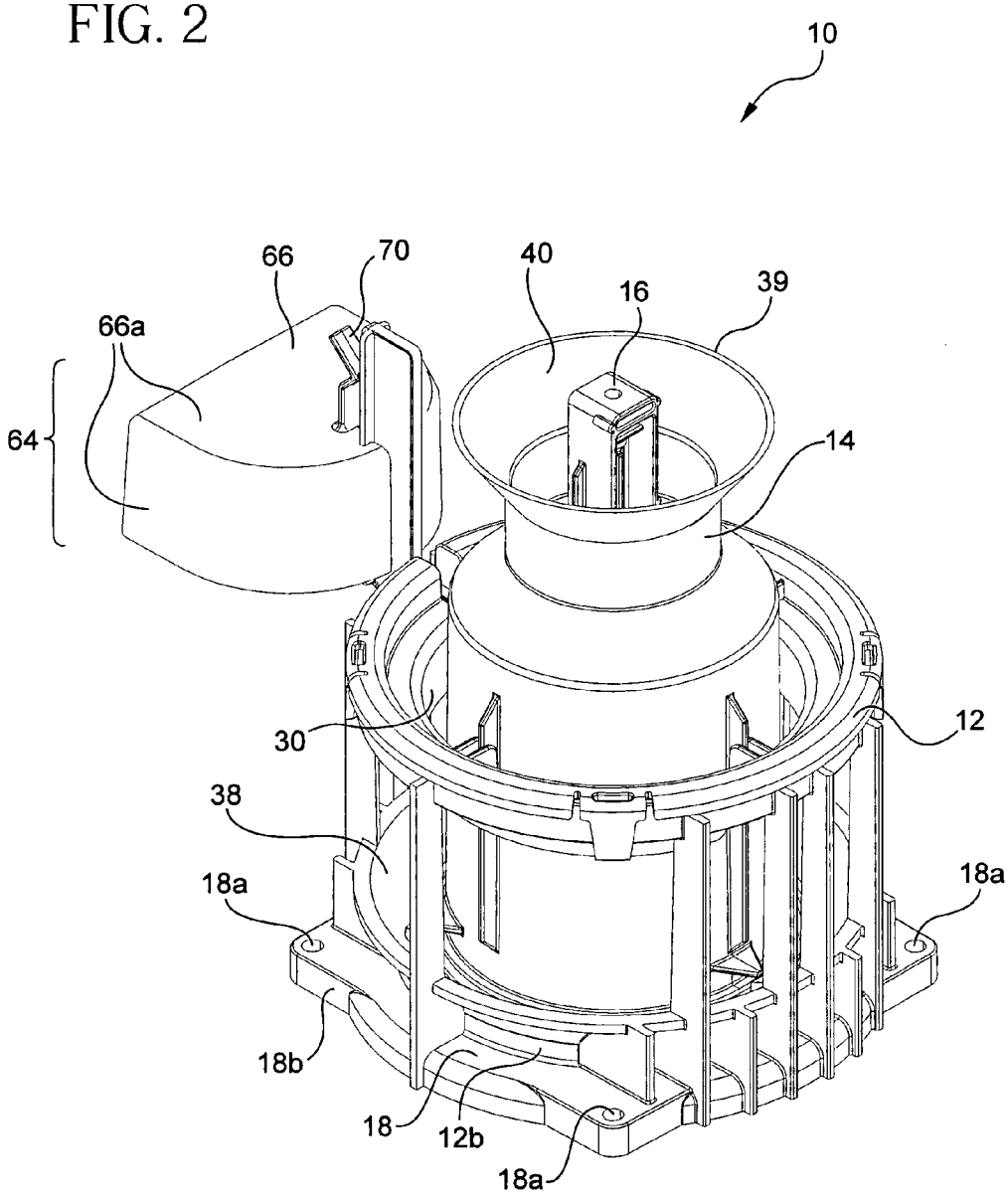
FIG. 2 shows a perspective view of a high-performance flush valve assembly of the present invention.
Figure 2A:
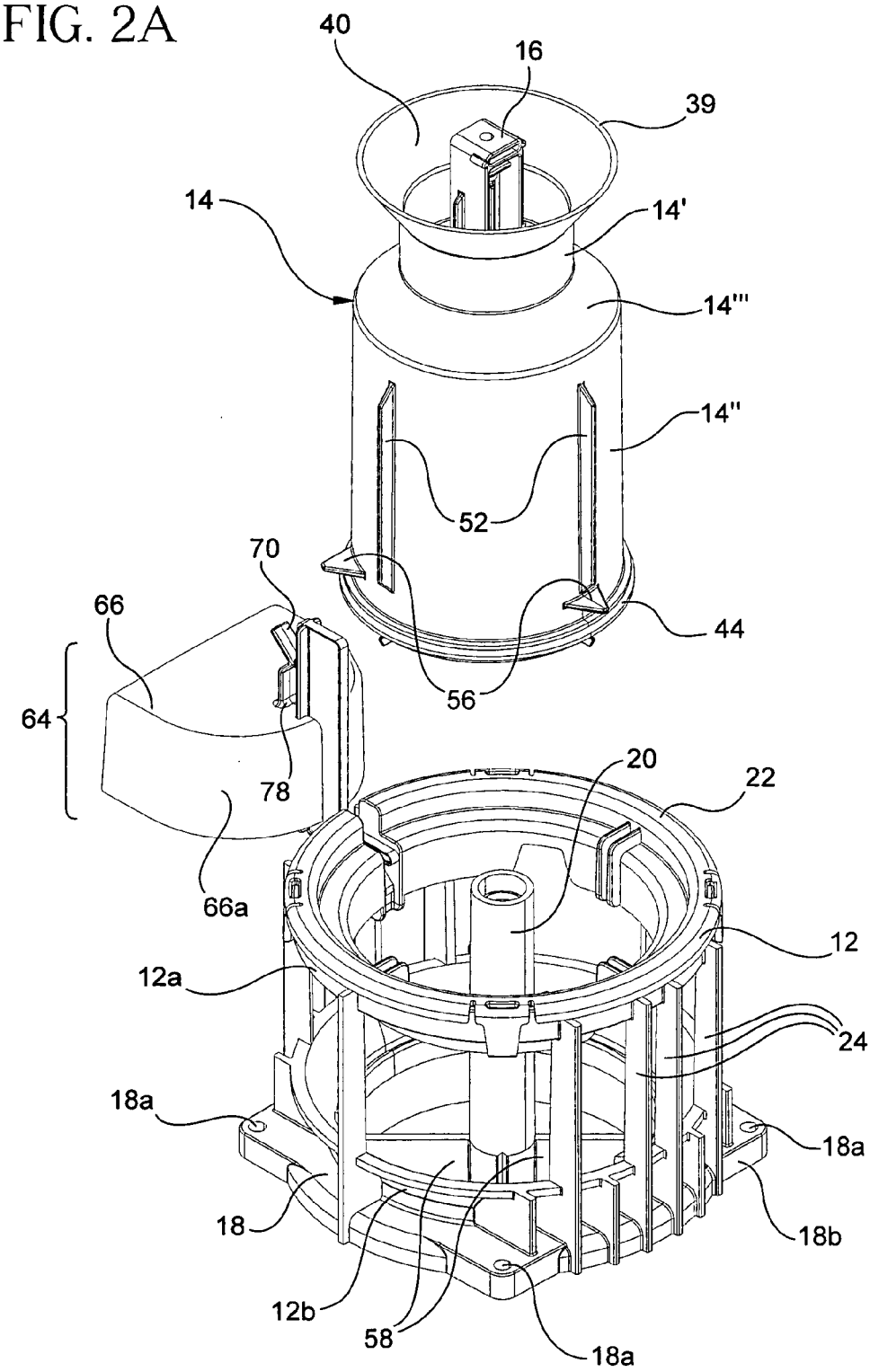
FIG. 2(A) shows the flush cover member of the flush valve assembly of FIG. 1 apart from the valve body thereof.

As shown in the figures and particularly shown in FIG. 2(A), flush cover member 14 includes an upper portion 14', a lower portion 14" and an intermediate portion 14'" therebetween which may be a stepped or inclined portion. The diameter of upper portion 14' may be smaller than that of lower portion 14". Additionally, annular sealing member 44 provided along the bottom surface of flush cover member 14 has a diameter that may exceed the diameter of lower portion 14". As particularly shown in FIG. 4, inner peripheral flange member 32 is disposed outside an outer circumferential surface of flush cover member 14, and lip 44*a* of flush cover member 14 rests thereon when the flush cover member is in its first rest position. O-ring 45 may be placed in communication with annular sealing member 44 to provide further sealing cooperation among flush cove member 14, valve body 12 and tank 7 within which flush valve assembly 10 is disposed. When the flush cover member 14 is in its second (floated) position so that flush valve opening 30 is unobstructed (see FIG. 5), water backflow tends to migrate (rise) in the interior space of flush cover member 14. In order to restrict further upward migration of the backflow, an annularly inclined baffle member 80 extends from an inner peripheral surface of flush cover member 14.

Intermediate portion 14''' and the diameter of annular sealing member 44 may be designed and/or selected so as to enable a force to be exerted on flush cover member 14 during a filling operation that is sufficient to pull flush cover member 14 down and cause a proper seal to be formed. Such force may be the minimum force necessary to pull flush cover member 14 down and provide the proper seal. The flow characteristics of the flush water and the flow capacity of flush valve assembly 10 are enhanced by reducing the pulling force necessary to close and properly seal the valve opening 30 when flush cover member 14 is moved from its second upper position to its first rest position. In accordance therewith, inner peripheral flange member 32 is provided downstream of radiused inlet 38 in valve opening 30.

In order to properly guide and align flush cover member 14 with respect to valve body 12 when flush cover member 14 is moved between its first rest position and its second position, flush cover member 14 includes a second inner cylindrical tube member 48 secured to the inner peripheral surface of an inner downwardly depending vertical wall member 50. Securement is desirably effected by a plurality of radially disposed web members (not shown) bridging second tube member 48 between inner wall member 50 and second cylindrical tube member 48. Second cylindrical tube member 48 is fitted over first cylindrical tube member 20 of valve body 12 so that flush cover member 14 is properly guided and accurately aligned with valve body 12 when flush cover member 14 is moved between its first rest position and its second position. This guiding assembly, comprising first and second cylindrical tube members 20 and 48, respectively, also assists in properly sealing valve opening 30 when flush cover member 14 returns to its first rest position. The guiding assembly assures that annular sealing member 44 is properly seated on inner peripheral flange member 32 when flush cover member 14 is in its first rest position.

Flush valve assembly 10 also includes a secondary float assembly 64 pivotably affixed to valve body 12. Float assembly 64 includes flotation cup 66 having a wall 66*a* defining the periphery thereof and a flotation cavity 68 therewithin. A resilient member 70 integral with flotation cup 66 engages one of a plurality of ratcheted teeth 72 provided on a cantilever portion 74 of pawl member 76. A recess 78 defined along a length of wall 66*a* adjacent pawl member 76 receives flange portion 80 thereof to effect securement of flotation cup 66 and pawl member 76 to one another (see FIG. 3). Flange portion 80 extends at least a portion of the length of cantilever portion 74 and includes lateral flange members extending along a plane from which ratcheted teeth 72 depend. Pawl member 76 further includes retention members 82 that receive a fastening element such as retention peg 84 shown in the drawings. Retention members 82 are provided in combination with primary finger 76*a* and secondary finger 76*b* that engage flush cover member 14 during reciprocating movement thereof, and more particularly engage integral tab portion 85 of flush cover member as flush cover member 14 moves relative to valve body 12. Secondary float assembly 64 communicates with valve body 12 and flush cover member 14 via engagement of the secondary float assembly with recess 86 of annular insert 22.

Figure 3:
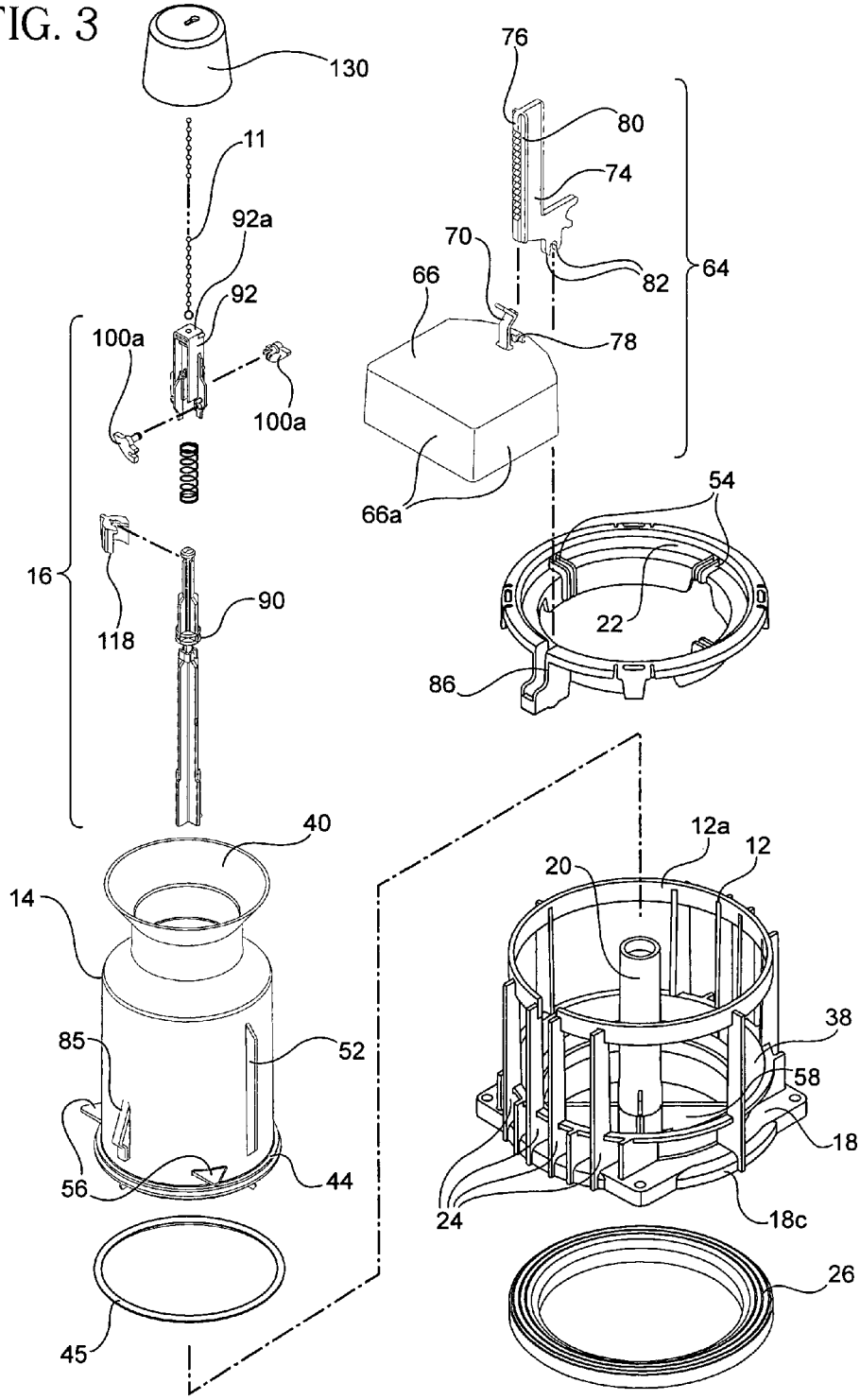
FIG. 3 shows an exploded view of the flush valve assembly of FIGS. 2 and 2(A).
Figure 4:
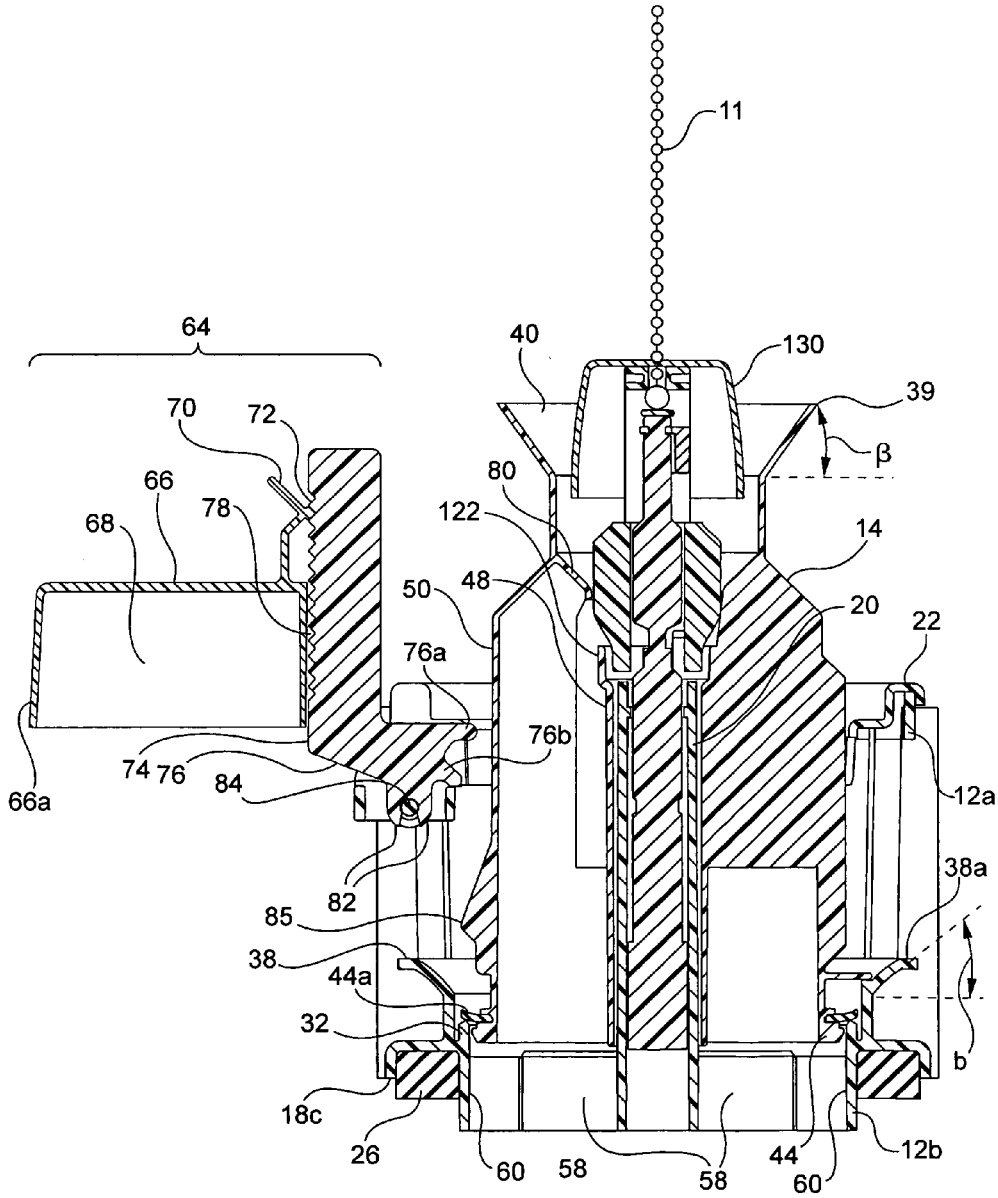
FIGS. 4, 5, 6 and 7 show a cross-sectional view of the flush valve assembly of the present invention, including the baffle cup and secondary float assembly thereof, while the flush valve assembly is in a closed position, during opening, in a fully opened position and during closing, respectively.
Figure 5:
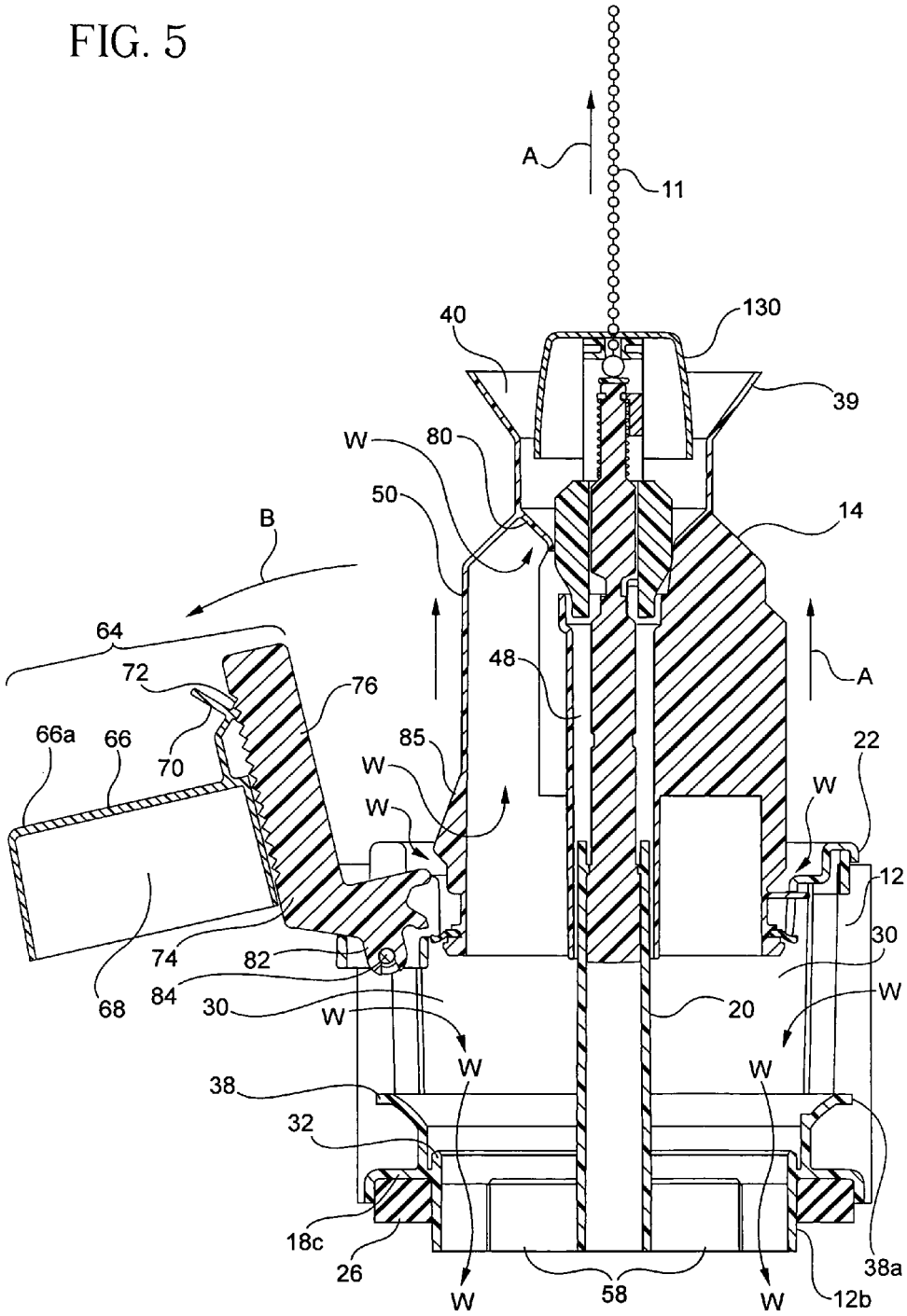
Figure 6:
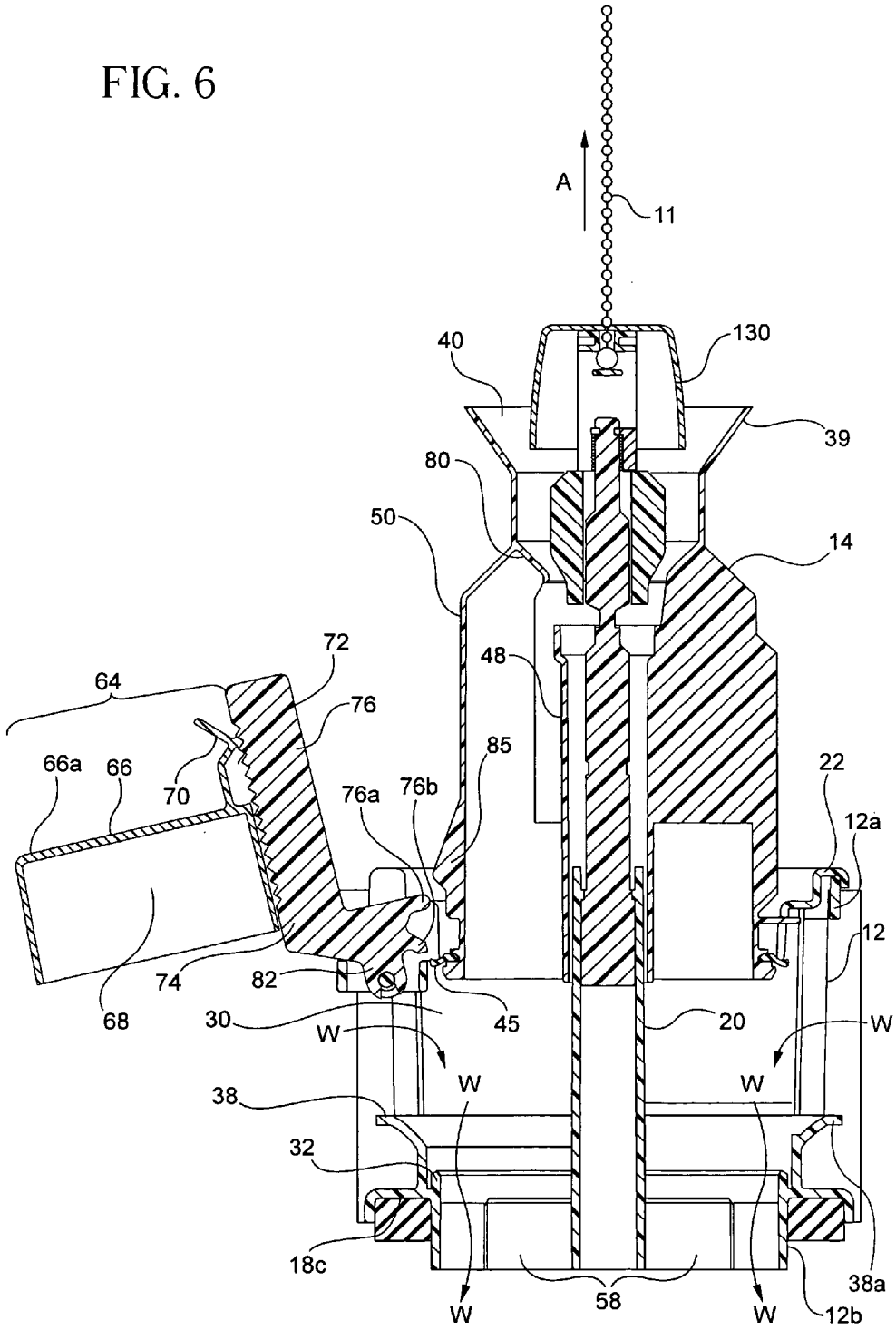
Figure 7:
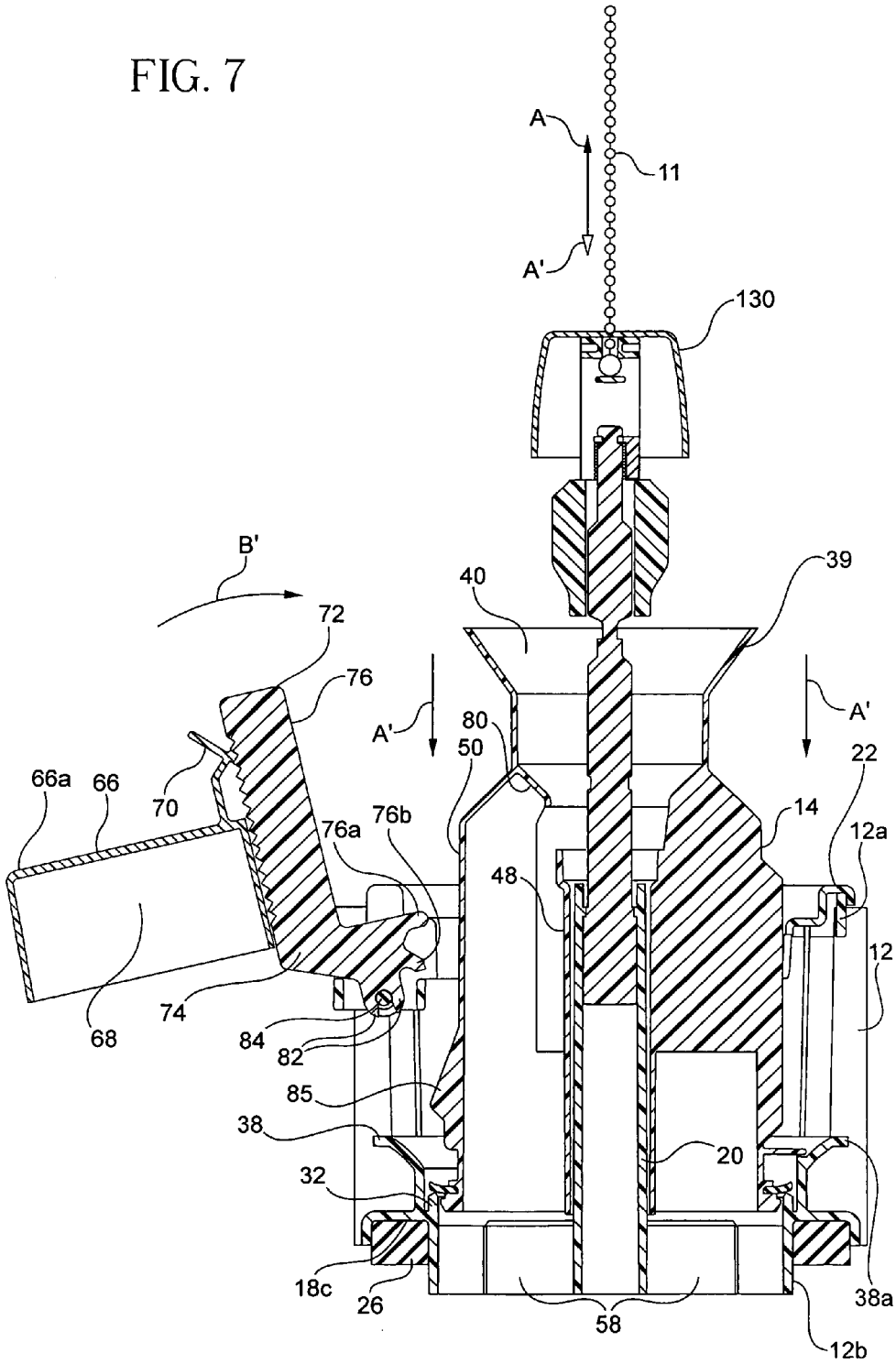

To further ensure reciprocating guidance of flush cover member 14 relative to valve body 12, flush cover member includes one or more alignment tabs 52 that remain in sliding engagement with corresponding tab recesses 54 provided in annular insert 22 (see FIG. 3). Alignment tabs 52 prevent rotation of flush cover member 14 and thereby ensure alignment of integral tab portion 85 with primary finger 76*a*. Upon assembly of annular insert 22 with valve body 12, alignment tabs 52 also enable longitudinal and central alignment of flush cover member 14 relative to valve body 12. Flush cover member 14 further includes one or more damper tabs 56 integrated along an outer circumferential periphery of lower portion 14''. Upon closure of valve opening 30, alignment tabs 52 and damper tabs 56 together ensure alignment and guidance of flush cover member 14 relative to valve body 12 and significantly reduce the noise inherently associated with the valve closing action. During movement, flush cover member 14 remains properly positioned relative to valve body 12 so that passage of flow water through valve opening 30 remains reliable and predictable. This improvement preserves the water conservation and performance benefits of the flush valve assembly and significantly enhances the valve's noise attenuation properties.

Referring more specifically to FIGS. 4 to 7, elevation of flush cover member 14 relative to valve body 12 in the direction of arrow A (see FIG. 5) causes tab member 85 of flush cover member 14 to engage primary finger 76*a* and further causes annular sealing member 44 to engage secondary finger 76*b*. Such engagement of the primary and second fingers articulates secondary float assembly 64 in the direction of arrow B (see FIG. 5) and retains float assembly 64 in this articulated position during entrance of water in the direction of arrows W (see FIGS. 5 and 6) through valve opening 30 and into tank 4. At the end of a flush cycle, flush cover member 14 returns in the direction of arrow A' to its seated position on inner peripheral flange member 32 of valve body 12 (see FIG. 7). The inter-action of this secondary float assembly 64 with the cylindrical closure component provides reliable valve closure with minimal variance in delivered flush water volume. This is a desirable feature that is particularly beneficial for applications with shallow reservoirs (i.e., one-piece toilets). By incorporating a secondary float assembly, flush valve assembly 10 achieves substantial improvements in the consistency of delivered flush volume without compromising flush performance.

Current regulatory mandates require that the minimum "hold down" time for the flush lever equal or exceed 1 second. It has been found, however, that the longer the valve opening remains open before evacuation of water from the tank, the more energy is dissipated during the flush cycle. Flush valve assembly 10 of the present invention achieves closure of valve opening 30 in less than 1 second, and preferably in 0.5 to 0.6 seconds, to increase the available hydraulic energy of the flush water and thereby ensure a relatively rapid delivery of a predetermined quantity of flush water without exceeding regulatory mandates.

Figure 12:
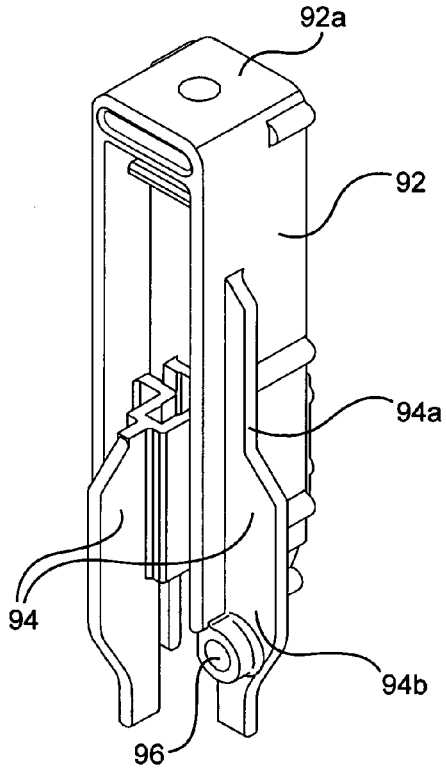
FIG. 12 shows a perspective view of a pull rod used in a trip release mechanism of the present invention.

In accordance therewith, flush valve assembly 10 includes trip release mechanism, 16 that, as described hereinbelow, releases the effect of flush lever 7 on flush cover member 14 when flush cover member 14 reaches its second position, thereby returning flush cover member 14 to its first rest position prior to the flush lever returning to its corresponding rest position. Trip release mechanism 14 includes a cam rod 90, a pull rod 92 operatively connected to flush lever 7 at end 92*a* and slidably mounted with respect to cam rod 90 so that pull rod 92 and cam rod 90 are moveable in response to movement of the flush lever. Pull rod 92 includes a plurality of extension members 94, each including a narrow width section 94*a* gradually increasing in width to a raised width section 94*b* (see FIG. 12). Raised width members 94*b* extend outwardly to an extent such that they are accepted readily within receiving opening 80*a* formed by an inner peripheral surface of annularly inclined baffle 80. Each of raised width members 94*b* includes an engaging hole 96 at a lower end thereof.

Figure 13:
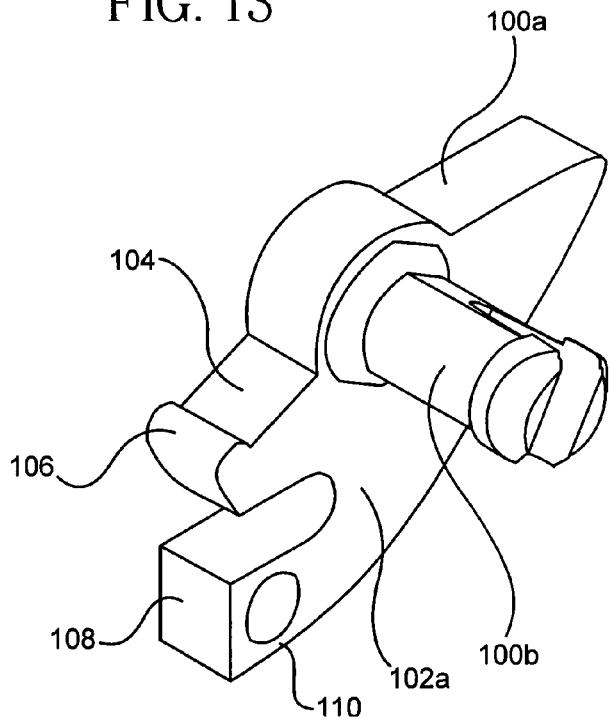
FIG. 13 shows a perspective view of a wing-like retention member used in cooperation with the pull rod of FIG. 12 in a trip release mechanism of the present invention.

Trip release mechanism 16 incorporates a trip dog assembly 100 that engages flush cover member 14 when pull rod 92 and cam rod 90 are moved between a first predetermined rest position and a second predetermined position. Trip dog assembly 100 disengages flush cover member 14 when pull rod 92 moves beyond its second predetermined position. The engaging and disengaging members of trip dog assembly 100 include wing-like retention members 100*a* that engage cam rod 90 in combination with integral fastening members 100*b* that are supported in engaging holes 96 of raised width members 94*b* (see FIG. 13). Each wing-like retention member 100*a* further includes an engagement section 104 that extends outwardly and is thereby repositioned upon pivoting of the wing-like retention member when cam rod 90 and pull rod 92 return to their first rest positions.

Figure 10:
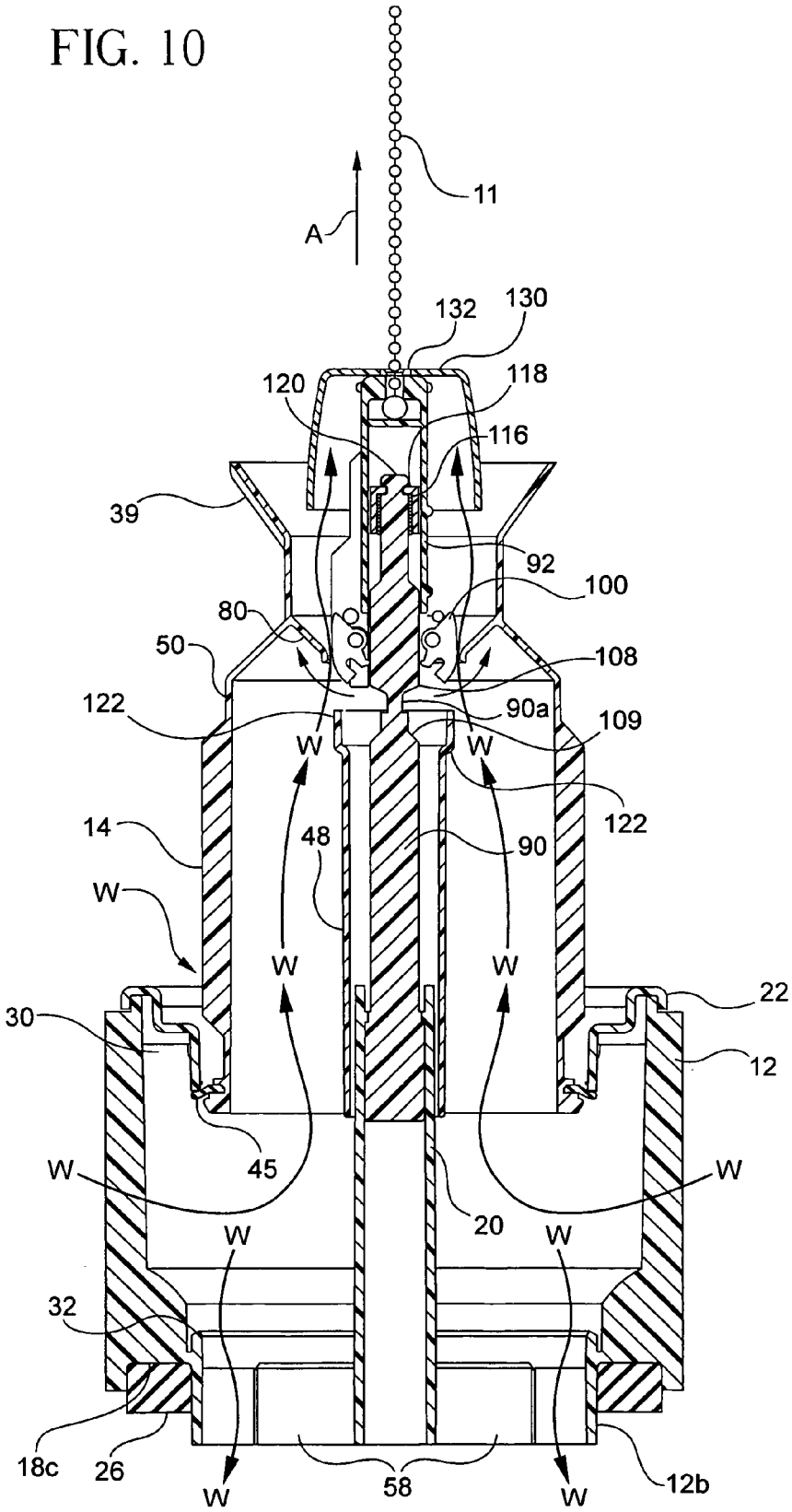
Figure 11:
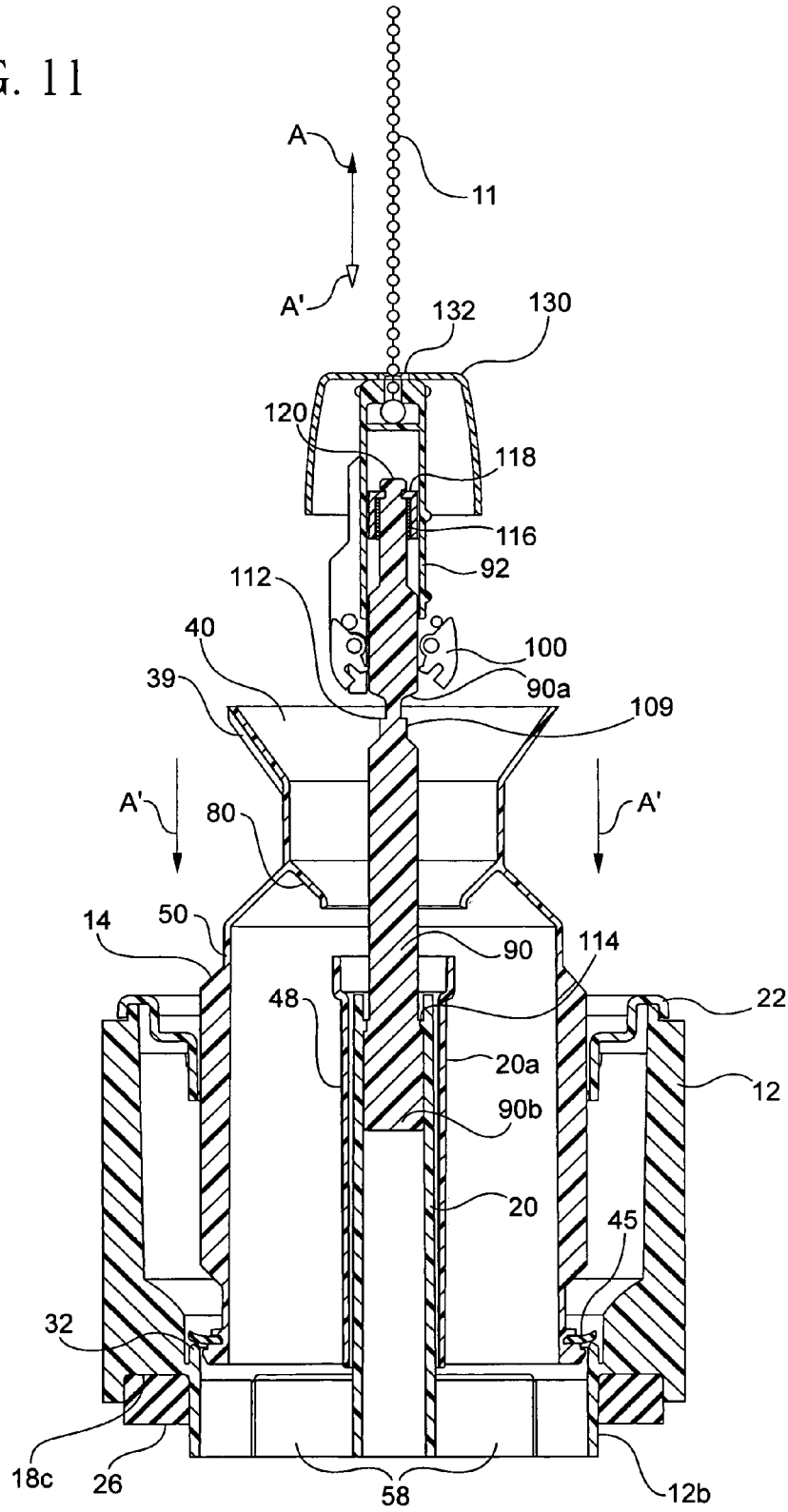

As particularly shown in FIG. 10, wing-like retention members 100*a* extend outwardly to engage flush cover member 14 when cam rod 60 and pull rod 62 move together in the direction of arrow A (see FIG. 9) between their first and second predetermined positions, correspondingly moving flush cover member 14 between its first rest and second positions. Further movement of cam rod 90 is restricted past this second predetermined position as will be described in further detail below. With the movement of cam rod 90 restricted, wing-like retention members 100*a* retract when pull rod 92 is moved past it second predetermined position so as to disengage wing-like retention members 100*a* from flush cover member 14, thereby allowing flush cover member 14 to return to its first rest position (see FIG. 11).

Figure 8:
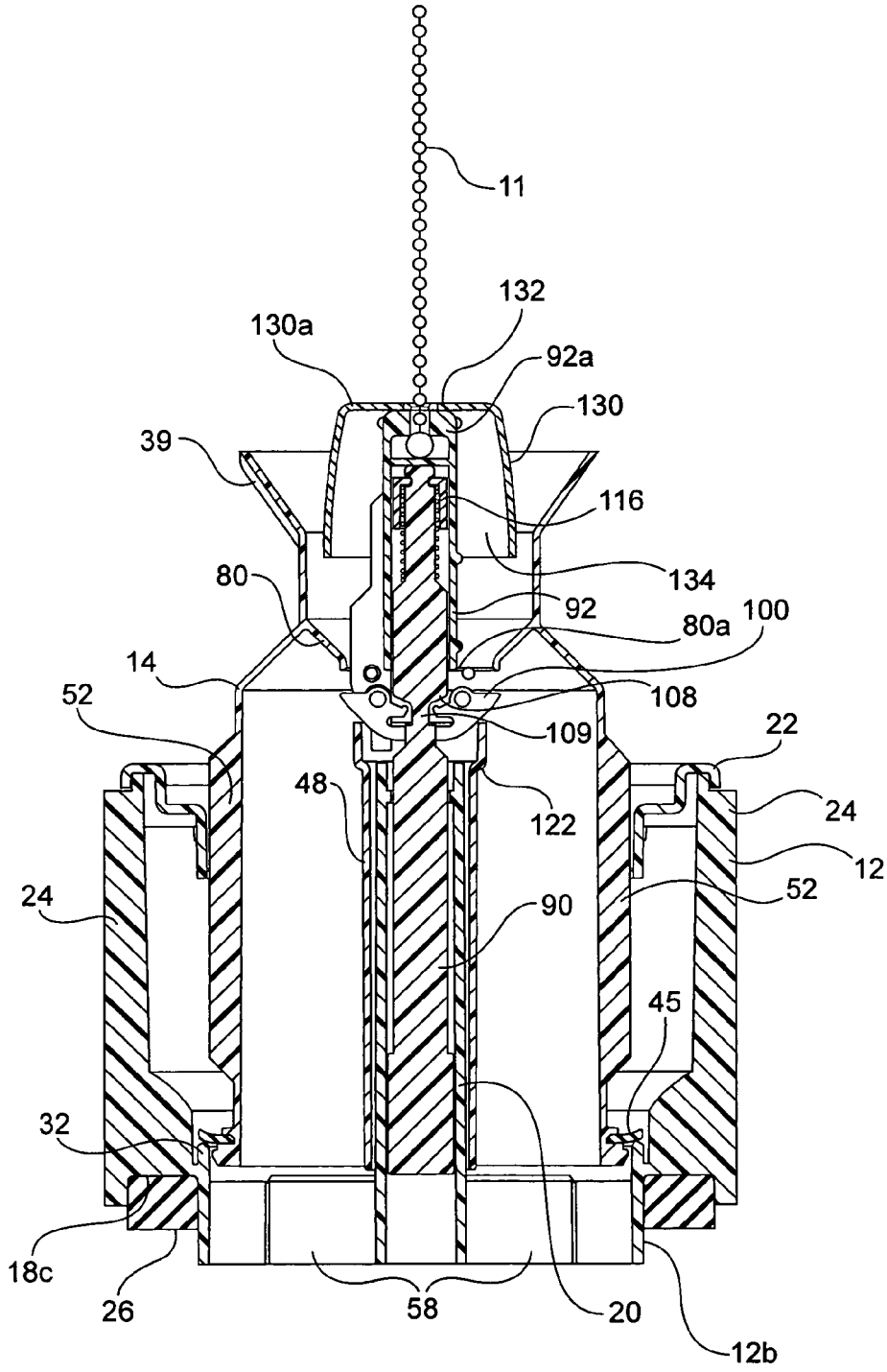
FIGS. 8, 9, 10 and 11 show cross-sectional views of the flush valve assembly of the present invention, including the trip release mechanism thereof, corresponding to the valve positions shown in FIGS. 4 to 7.
Figure 9:
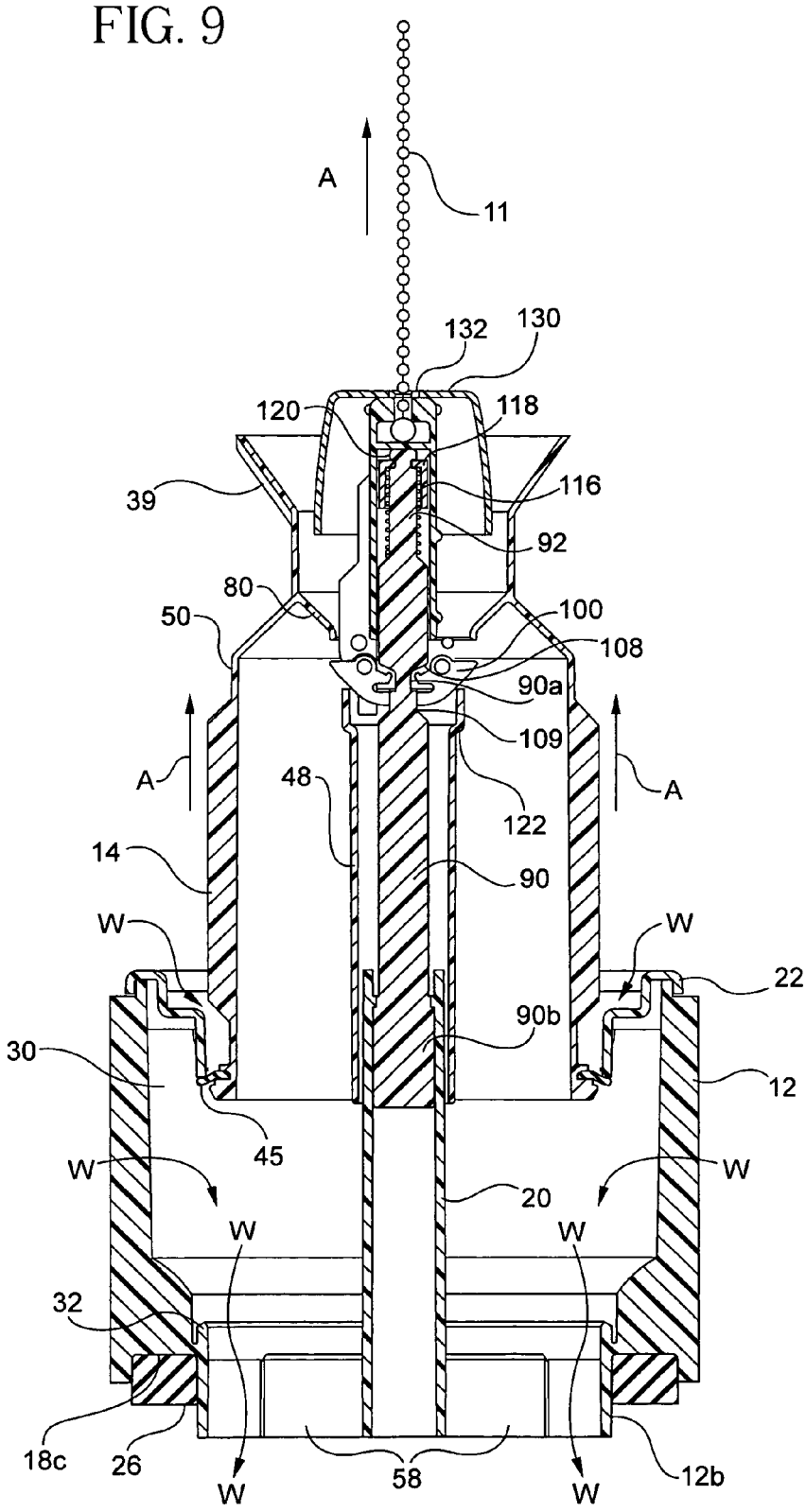

More specifically, as shown in FIG. 8, in the first rest position of cam rod 90 and pull rod 92, a first catch member 106 of each wing-like retention member 100*a* abuts against a leading inclined surface 108 of a central depression cam section 90*a* of cam rod 90. A leading edge 108 of a second catch member 110 of each wing-like retention member 100*a* abuts against the reduced diameter section 109 of central depression cam section 90*a* of cam rod 90. Thus, as flush lever 7 initially moves cam rod 90 and pull rod 92 from their initial rest positions, first and second catch members 106 and 110 are retained adjacent central depression cam section 90*a* of cam rod 90. Upon further combined movement of cam rod 90 and pull rod 92 due to further depression of flush lever 7, each retention member 100*a* engages annularly inclined baffle member 80 (see FIG. 10) that extends from an inner peripheral surface of flush cover member 14, consequently raising flush cover member 14 from its first rest position to its second upper position (wherein valve opening 30 is unobstructed). When cam rod 90 and pull rod 92 have moved to the second predetermined position upon depression of flush lever 7, annular base flange 112 provided on base section 90*b* of cam rod 90 abuts against inwardly extending flange 114 provided at top end 20*a* of first cylindrical tube member 20 of valve body 12 (see FIG. 11). This configuration restricts further movement of cam rod 90 with pull rod 92 as flush lever 7 is further depressed.

When pull rod 92 is moved past its second predetermined position by further depression of the flush lever, pull rod 92 is subjected to additional bias force being applied by a spring member 116 that is fitted over an upper portion of cam rod 90 and loaded between a central core member 118 of the pull rod 92 (see FIG. 9) and a spring knob 120 provided at an upper end of cam rod 90. Spring member 116 ensures that each retention member 100*a* returns to its rest position upon completion of each flush cycle. Since cam rod 90 is restricted from further movement, when pull rod 92 is moved past the second predetermined position and the biased force is initially applied thereto, first and second catch members 106 and 110 ride out of central depression cam section 90*a* of cam rod 90. This, in turn, causes wing-like retention members 100*a* to pivot such that engagement sections 104 of the retention members are retracted toward pull rod 92 and disengaged from annularly inclined baffle member 80 of flush cover member 14. Consequently, since flush lever 7 is connected to pull rod 92, flush cover member 14 is no longer under the effect of the flush lever. Once the flush cover member is unrestrained, flush cover member 14 is capable of returning to its first rest position. Pull rod 92 continues its upward movement past the second predetermined position until central core member 118 abuts against spring knob 120. At this point, further movement of pull rod 92 is restricted.

The disclosed flushing operation closes the valve opening in approximately 0.5 to 0.6 seconds, providing a relatively quick flush operation and significantly reducing energy dissipation of the flush water during the flushing operation. Even though flush cover member 14 returns to its first rest position to close valve opening 30, pull rod 92 continues to move upwardly until the flush lever has complied with its mandatory 1 second "hold down" time.

In addition, the second cylindrical tube member 48 of flush cover member 14 includes an annular extended flange 122 at an upper end thereof. When cam rod 90 and pull rod 92 return to their first rest position in a subsequent flushing operation and the effect of the flush lever is released, camming surfaces on retracted retention members 100*a* abut annular extended flange 122 and ride thereover. Wing-like retention members 100*a* are thereby cammed to an extended engageable position so that first catch member 106 of each wing-like retention member 100*a* abuts against the leading inclined surface 108 of central depression cam section 90*a*. The wing-like retention members are pivoted into a position whereby the engaging member is capable of engaging annularly inclined baffle member 80 of flush cover member 14 in a subsequent flush operation.

During the engagement and disengagement of flush valve cover 14 as described hereinbove, articulation of flush lever 7 communicates movement to flush cover member 14 via activation chain 11, which specifically communicates with pull rod 92 at end 92*a* thereof (see FIGS. 8 to 11). Upon movement of chain 11 and corresponding movement of pull rod 92, baffle cup 130 also moves accordingly in the direction of arrow A (see FIG. 10). Baffle cup 130 includes aperture 132 along an upper periphery 130*a* thereof to permit ingress of chain 11 therethrough. A free end of chain 11 is captured in upper end 92*a* of pull rod 92, thereby retaining baffle cup 130 centrally relative to a longitudinal extent of pull rod 92 and cam rod 90. Baffle cup 130 is a generally cylindrical element having a float cavity 134 defined therewithin. Baffle cup 130 follows the path of pull rod 92 during the flushing operation and descends along with pull rod 92 after closure of valve opening 30. Incorporation of baffle cup 130 substantially attenuates splash-back of water through tank 4 and any undesirable noise associated therewith upon refilling of tank 4. By significantly reducing splashing within tank 4, baffle cup 130 desirably reduces atomization of chlorinated water and thereby prevents rapid corrosion of valve and tank components.

Various changes to the foregoing described and shown structures are now evident to those skilled in the art. The matter set forth in the foregoing description and accompanying drawings is therefore offered by way of illustration only and not as a limitation. Accordingly, the particularly disclosed scope of the invention is set forth in the following claims.

What is claimed is:

1. A flush valve assembly for a water tank of a toilet, comprising:

a valve body, said valve body including a base portion that is secured to said water tank, and a first cylindrical tube member that extends longitudinally upward from said base portion along a longitudinal axis of said valve body, wherein said first cylindrical tube member is concentrically defined relative to an annular support that supports an annular insert thereon and an annular base adjacent said base portion;

a flush cover member having a predetermined length, said flush cover member being coaxially and slidably mounted with respect to said valve body so as to create a valve opening therebetween when said flush cover member is removed from said valve body; said flush cover member being slidably movable between a first rest position, wherein said flush cover member is seated on an inner peripheral flange member of said base portion of said valve body to obstruct fluid flow through said valve opening, and a second position, wherein said flush cover member is removed from said inner peripheral flange member to allow water to pass through said valve opening; and guiding means for properly guiding and aligning said flush cover member with respect to said valve body when said flush cover member is moved between said first and second positions;

wherein said guiding means includes a second cylindrical tube member secured to said flush cover member which is slidably fitted over said first cylindrical tube member so that said flush cover member is properly guided and accurately aligned with said valve body when said flush cover member is moved between its said first and second positions; said guiding means further including at least one alignment tab on said flush cover member that remains in sliding engagement with at least one corresponding tab recesses defined in said valve body so as to enable longitudinal and central alignment of said flush cover member relative to said valve body.

2. The flush valve assembly of claim 1, wherein second cylindrical tube member, together with a downwardly depending vertical wall, defines a flotation cavity in said flush valve cover.

3. The flush valve assembly of claim 1, wherein said flush cover member includes means for restricting upward back-flow migration when said flush cover member is initially moved from said first rest position to said second position.

4. The flush valve assembly of claim 3, wherein said backflow restriction means includes an annularly inclined baffle member extending from an inner peripheral surface of said flush cover member.

5. The flush valve assembly of claim 1, further including a secondary float assembly pivotably affixed to said valve body.

6. The flush valve assembly of claim 5, wherein said secondary float assembly assembly includes a flotation cup having a wall defining the periphery thereof and a flotation cavity therewithin; and a resilient member integral with said flotation cup, wherein said resilient member engages one of a plurality of ratcheted teeth provided on a cantilever portion of a pawl member in communication therewith.

7. The flush valve assembly of claim 6, wherein a recess is defined along a length of said wall adjacent said pawl member so as to receive a flange portion thereof and effect securement of said flotation cup and said pawl member to one another.

8. The flush valve assembly of claim 6, wherein said pawl member further includes retention members in combination with each of a primary finger and a secondary finger that engage said flush cover member during reciprocating movement thereof.

9. The flush valve assembly of claim 8, wherein said flush cover member includes an integral tab portion along an outside peripheral surface thereof that engages at least one of said primary finger and said secondary finger when said flush cover member moves between its first rest position and its second position.

10. The flush valve assembly of claim 5, wherein said secondary float assembly communicates with said valve body and said flush cover member via engagement of said secondary float assembly with a portion of said valve body.

11. The flush valve assembly of claim 1, further including a flush lever displaceable by a user between a first rest position and a second position to operatively move said flush cover member between its first rest position and its second position, respectively.

12. The flush valve assembly of claim 11, wherein said flush valve assembly further includes trip release means for releasing the effect of said flush lever on said flush cover member when said flush cover member reaches its second position so as to return to said flush cover member to its first rest position prior to said flush lever returning to said first rest position thereof.

13. The flush valve assembly of claim 12, wherein said trip release means is a trip release mechanism coaxially mounted with respect to said valve body and said flush cover member, said trip release mechanism including a cam rod; a pull rod operatively connected to said flush lever and slidably mounted with respect to said cam rod so that said pull rod and said cam rod are movable in response to movement of said flush lever; and a trip dog assembly including means for engaging said flush cover member when said pull rod and cam rod are moved between a first rest position and a second predetermined position, and means for disengaging said flush cover member when said pull rod moves beyond its second predetermined position; wherein said cam rod of said trip release mechanism is mounted within said first cylindrical tube of said valve body; and wherein said first cylindrical tube me of said valve body includes an inwardly extending annular flange member to restrict movement of said cam rod past its second predetermined position.

14. The flush valve assembly of claim 13, wherein said flush cover member engaging and disengaging means of said trip dog assembly includes at least one wing-like retention member that extends outwardly to engage said flush cover member when said pull rod is moved between its first predetermined position and its second predetermined position to move said flush cover member between its first rest position and its second position, and which retracts when said pull rod is moved past said second predetermined position, disengaging said at least one wing-like retention member from said flush cover member so as to allow said flush cover member to return to its said first rest position.

15. The flush valve assembly of claim 14, wherein said at least one wing-like retention member is engaged with the annularly inclined baffle member of claim 4 when said pull rod is moved between its said first rest position and its second predetermined position.

16. The flush valve assembly of claim 15, wherein said at least one wing-like retention member is retracted when said pull rod is moved past its second predetermined position, thereby disengaging said at least one wing-like retention member from said annularly inclined baffle member to thereby allow said flush cover member to return to its first rest position.

17. The flush valve assembly of claim 14, wherein said at least one wing-like retention member is engaged within a central depression section of said cam rod so as to cooperatively move said cam rod and said pull rod between their said first and second predetermined positions.

18. The flush valve assembly of claim 14, wherein said second cylindrical tube of said flush cover member has an annular flange on an end thereof that repositions said at least one wing-like retention member to an extended engageable position when said cam rod and said pull rod are returned to their first rest position to properly align said flush cover member with respect to said valve body during movement of said flush cover member between its first rest position and its second position.

19. The flush valve assembly of claim 13, wherein said pull rod is spring-loaded with respect to said cam rod.

20. The flush valve assembly of claim 19, wherein said flush lever is operatively connected and slidably mounted with respect to said cam rod so that said pull rod and said cam rod are moveable in response to movement of said flush lever.

21. The flush valve assembly of claim 1, wherein said flush cover member further includes at least one damper tab disposed along an outer circumferential periphery of a lower portion thereof.

22. The flush valve assembly of claim 1, wherein said valve body is secured to said tank by one or more fasteners inserted through corresponding apertures provided along an outer peripheral extent of said base portion.

23. The flush valve assembly of claim 1, wherein said valve body further includes a plurality of support members distributed generally circumferentially around a periphery of said valve body defined by relative placement of said annular support and said annular base.

24. The flush valve assembly of claim 1, further including a sealing member provided adjacent said valve body so as to abut said base portion and thereby seal said flush valve assembly with said tank.

25. The flush valve assembly of claim 1, wherein said flush cover member includes a funneled inlet at a flush water inlet orifice, said funneled inlet having a predetermined lead-in angle relative to the horizontal axis of said flush cover member.

26. The flush valve assembly of claim 1, wherein said flush valve cover includes an annular sealing member having a lip that rests on said inner peripheral flange member defined along an inner circumferential surface of said valve body when said flush cover member is in its first rest position.

27. The flush valve assembly of claim 26, further including an O-ring in communication with said annular sealing member.

28. The flush valve assembly of claim 12, further including a baffle cup having an outer periphery that defines a float cavity therewithin and having at least one aperture provided therethrough to establish communication among said flush lever, said baffle cup and said trip release means.

29. The flush valve assembly of claim 1, wherein said valve body includes means for minimizing flow resistance.

30. The flush valve assembly of claim 29, wherein said flow resistance minimization means includes a plurality of tapered web members radially disposed between said first cylindrical tube member and said base portion.

* * * * *